US012392113B2

(12) United States Patent
Nakamoto et al.

(10) Patent No.: US 12,392,113 B2
(45) Date of Patent: Aug. 19, 2025

(54) SYSTEM, METHOD, AND MACHINE FOR POSITION DETERMINATION OF THUMB BUCKET

(71) Applicant: Caterpillar SARL, Geneva (CH)

(72) Inventors: Youzou Nakamoto, Akashi (JP); Keisuke Shirani, Akashi (JP); Michio Aoki, Akashi (JP)

(73) Assignee: Caterpillar SARL, Geneva (CH)

( * ) Notice: Subject to any disclaimer, the term of this patent is extended or adjusted under 35 U.S.C. 154(b) by 278 days.

(21) Appl. No.: 18/073,618

(22) Filed: Dec. 2, 2022

(65) Prior Publication Data

US 2024/0183129 A1 Jun. 6, 2024

(51) Int. Cl.
*E02F 9/26* (2006.01)
*E02F 3/413* (2006.01)

(52) U.S. Cl.
CPC ..... *E02F 9/26* (2013.01); *E02F 3/4135* (2013.01)

(58) Field of Classification Search
None
See application file for complete search history.

(56) References Cited

U.S. PATENT DOCUMENTS

| | | | | |
|---|---|---|---|---|
| 5,782,018 | A | 7/1998 | Tozawa et al. | |
| 6,203,267 | B1 | 3/2001 | Heiple et al. | |
| 9,353,500 | B1 | 5/2016 | Andreski | |
| 9,555,706 | B1 * | 1/2017 | Mitchell | B60W 10/02 |
| 2010/0161185 | A1 * | 6/2010 | Marathe | E02F 3/431 701/50 |
| 2011/0318158 | A1 * | 12/2011 | Miller | E02F 3/962 414/815 |
| 2014/0336874 | A1 * | 11/2014 | Harshberger, II | E02F 9/264 701/36 |
| 2014/0371994 | A1 * | 12/2014 | Buettner | E02F 9/267 701/1 |
| 2020/0232189 | A1 | 7/2020 | Yamanobe et al. | |
| 2023/0417023 | A1 * | 12/2023 | Itoh | E02F 9/20 |

FOREIGN PATENT DOCUMENTS

| | | | |
|---|---|---|---|
| JP | S63-001054 | U | 1/1988 |
| JP | H08-151657 | A | 6/1996 |
| JP | 2008-050791 | A | 3/2008 |
| JP | 4223377 | B2 | 2/2009 |
| JP | 4319529 | B2 | 8/2009 |
| JP | 2020-165253 | A | 10/2020 |
| JP | 2021-152275 | A | 9/2021 |
| JP | 2021-156084 | A | 10/2021 |
| WO | 2015166210 | A1 | 11/2015 |

OTHER PUBLICATIONS

Written Opinion and International Search Report for Int'l. Patent Appln. No.PCT/EP2023/025498, mailed Feb. 16, 2024 (10 pgs).

* cited by examiner

*Primary Examiner* — Christian Chace
*Assistant Examiner* — Shayne M. Gilbertson

(57) ABSTRACT

A work machine comprises a bucket attached to an end of a stick of the work machine as a work tool, a thumb pivotally coupled to the end of the stick, and processing circuitry. The processing circuitry is configured to determine a current task of the work machine among scooping an object by the bucket or grabbing the object by the bucket and the thumb, based on an angle of the bucket, and calculate payload with a parameter of a center of gravity position of the payload based on the determined current task.

19 Claims, 11 Drawing Sheets

| 201 Weigh Status | 202 Icon Status | | | |
|---|---|---|---|---|
| | 203 Thumb Scoop | 204 Thumb Grab | 205 Bucket | 206 Grapple |
| 211 Estimated Weight Complete |  |  |  |  |
| 212 Estimated Weighing |  |  |  |  |
| 213 Scaled Weight Complete |  |  |  |  |
| 214 Scaled Weighing |  |  |  |  |

SYSTEM, METHOD, AND MACHINE FOR POSITION DETERMINATION OF THUMB BUCKET

TECHNICAL FIELD

The present disclosure relates to work machines, and more particularly to construction machines having a thumb bucket for grabbing or scooping an object, and systems, assemblies, and methods thereof.

BACKGROUND

Certain types of construction machines (e.g., excavators) may provide an arm which may include a boom having a stick pivotally connected to the boom. A bucket is pivotally connected to the stick. In some instances, a thumb may also be connected to the stick which can open or close over the bucket. This type of structure may be called as "a thumb bucket" which may be generally understood in the industry as an implement where the thumb may generally oppose the bucket for grasping material held between the bucket and the thumb.

Work machines having the thumb bucket may perform grabbing an object or scooping soil in accordance with circumstances, however, it may be difficult to determine payload accurately when the tasks of grabbing the object and scooping soil are performed in random order. It has been desired to be able determine payload accurately regardless of the order of tasks.

SUMMARY

According to an aspect a work machine is described or provided. The work machine can comprise a bucket attached to an end of a stick of the work machine as a work tool, a thumb pivotally coupled to the end of the stick, and processing circuitry. The processing circuitry can be configured to determine a current task of the work machine among scooping an object by the bucket or grabbing an object by the bucket and the thumb, based on an angle of the bucket, and calculate payload with a parameter of a center of gravity position of the payload based on the determined current task.

In another aspect, a method for a work machine is disclosed or implemented. The method can comprise determining a current task of the work machine among scooping an object by a bucket or grabbing an object by the bucket and a thumb, based on an angle of the bucket, the bucket being attached to an end of a stick of the work machine as a work tool and the thumb being pivotally coupled to the end of the stick, calculating payload with a parameter of a center of gravity position of the payload based on the determined current task, and outputting, on a display of the work machine, the calculated payload.

And in another aspect a non-transitory computer-readable storage medium is disclosed or provided. The non-transitory computer-readable storage medium can comprise computer executable instructions, wherein the instructions, when executed by an information processing system of a work machine, cause the information processing system to perform a method, the method comprising, setting a mode for calculation of payload as an automatic mode, determine a current task of the work machine among scooping an object by a bucket or grabbing an object by the bucket and a thumb, based on an angle of the bucket, the bucket being attached to an end of a stick of the work machine as a work tool and the thumb being pivotally coupled to the end of the stick, and calculating payload with a parameter of a center of gravity position of the payload based on the determined current task.

Other features and aspects of this disclosure will be apparent from the following description and the accompanying drawings.

DETAILED DESCRIPTION

The present disclosure relates to work machines, and more particularly to construction machines having a thumb bucket for grabbing or scooping an object, and systems, assemblies, and methods thereof. Generally, embodiments of the disclosed subject matter can implement the work machine that can determine whether the work machine is performing grabbing or scooping with a thumb bucket, and automatically switch a center of gravity position of payload based on the performing task so that the work machine can determine payload accurately regardless of the order of the tasks.

Figure 1:
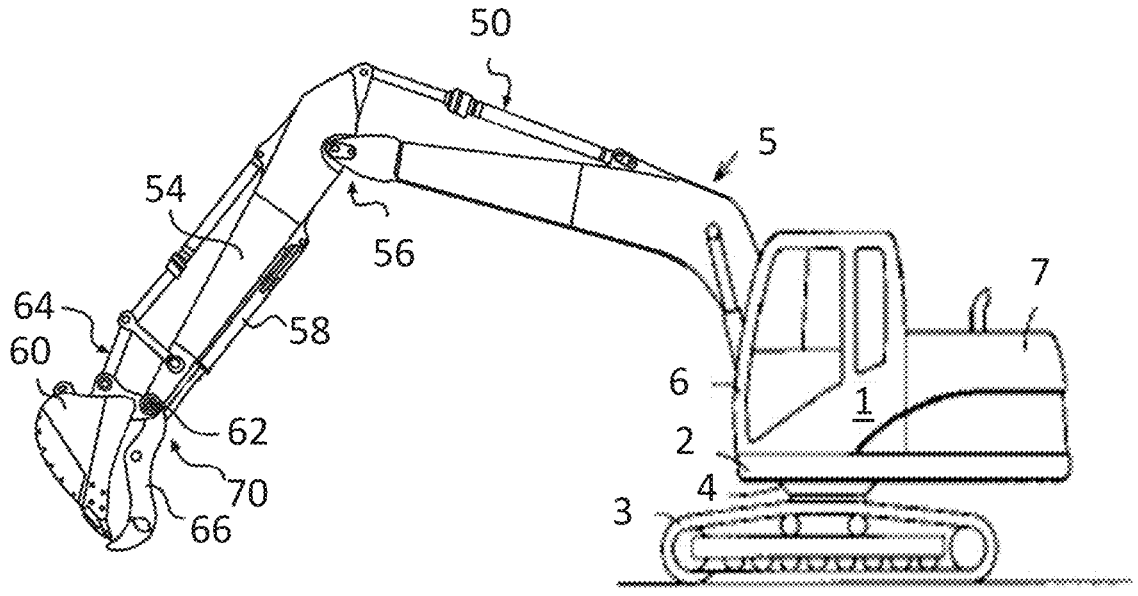
FIG. 1 is a side view of an excavator as an example of a work machine according to one or more embodiments of the disclosed subject matter.

Turning to the figures, FIG. 1 shows a hydraulic excavator as a work machine 1, according to one or more embodiments of the disclosed subject matter, though embodiments of the disclosed subject matter are not so limited to hydraulic excavators. Regarding the work machine 1, an upper swing body 2 can be rotatably provided as a machine body on a lower traveling body 3, via a swing bearing portion 4. A cab 6 can be mounted on one side of a front part of the upper swing body 2, and a driver's seat, an operation lever, a foot pedal, and other components can be installed in the cab 6. Furthermore, a boom 5 for excavation work can be mounted on the other side of the front part of the upper swing body 2. An engine and a power device such as a hydraulic pump which is driven by the engine can be mounted on the rear part of the upper swing body 2 and covered with a power device cover.

The work machine 1 can include an arm 50 that may be used in various pieces of excavating equipment and not just the example work machine 1 shown. The arm 50 can include the boom 5 pivotally attached to a stick 54 via a pivot joint 56. The stick 54 may be terminated with a work tool such as a bucket 60. The bucket 60 can be pivotally connected by pivot joint 62 to the stick 54. The bucket 60 may also include a linkage 64 which may be attached to a hydraulic cylinder. The arm 50 may also be equipped with a thumb 66. The thumb 66 may be actuated by a hydraulic cylinder 58 attached to a linkage 70. The linkage 70 and other linkage that is associated with the hydraulic cylinder 58 may not be completely shown to avoid overcrowding FIG. 1.

The thumb 66 may pivot about the pivot joint 62. The thumb 66 may move, close to or in contact with the bucket 60 to allow the arm 50 pickup various objects. Furthermore, the thumb 66 may be used as a cover for the bucket 60 to avoid or hinder material contained in the bucket 60 from falling out. When the thumb 66 is in a position distal from the bucket 60, the thumb 66 may be proximate to or even in contact with the stick 54.

Figure 2A:
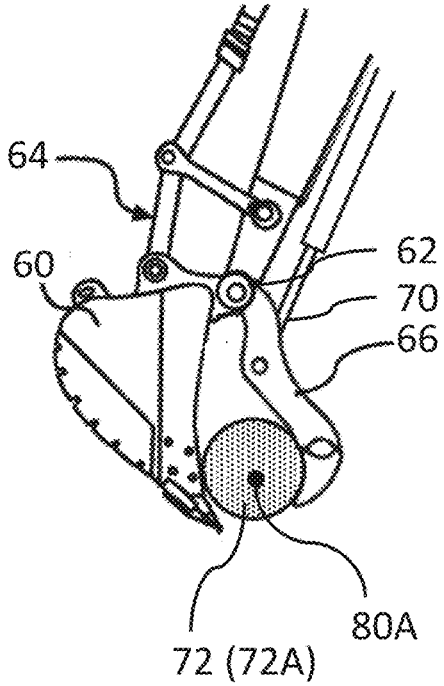
FIGS. 2A and 2B are side views of a part of an arm of a work machine having a thumb bucket according to one or more embodiments of the disclosed subject matter.
Figure 2B:
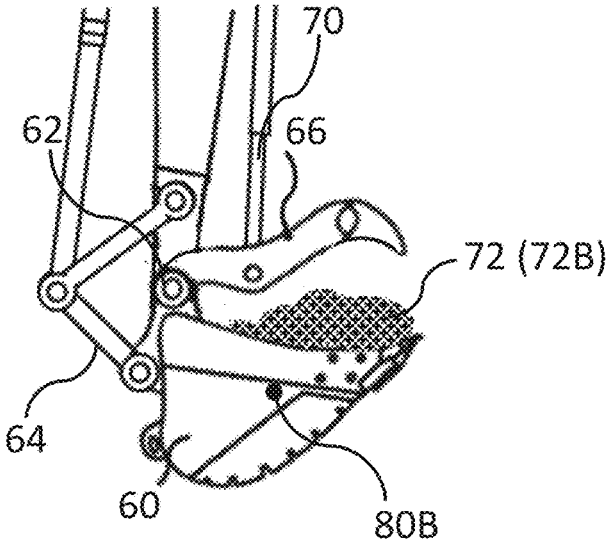

Turning now to FIGS. 2A and 2B, FIGS. 2A and 2B are side views of a part of an arm of a work machine 1 having a thumb bucket according to one or more embodiments of the disclosed subject matter. As illustrated in FIG. 2A, the work machine 1 can grab material 72A (e.g., timber, rocks and/or other materials) by clamping the material 72A with the bucket 60 and the thumb 66. Also, as illustrated in FIG. 2B, the work machine 1 can scoop material 72B (e.g., dirt, rocks, sand, bricks, and/or other materials) up by curling the bucket 60. In one or more embodiments of the disclosed subject matter, a center of gravity position (COG) of a total weight of the material and the bucket 60 (hereinafter, COG of the material and the bucket 60) may be indicated as 80A and 80B, respectively.

More specifically, when the task of the work machine 1 is scooping (shown in FIG. 2B), the bucket 60 may need to be curled up and the COG of the material and the bucket 60 may be located inside the bucket 60. On the other hand, when the task of the work machine 1 is grabbing (shown in FIG. 2A), the bucket 60 may not need to be curled up and the COG of the material and the bucket 60 may be located outside the bucket 60. Accordingly, the COG of the material and the bucket 60 may be different based on the tasks of the work machine 1 (i.e., grabbing or scooping). In order to determine payload of the work machine 1 accurately, it may be required to determine a current task of the work machine 1 and the COG of the material and the bucket 60 correctly.

Figure 3A:
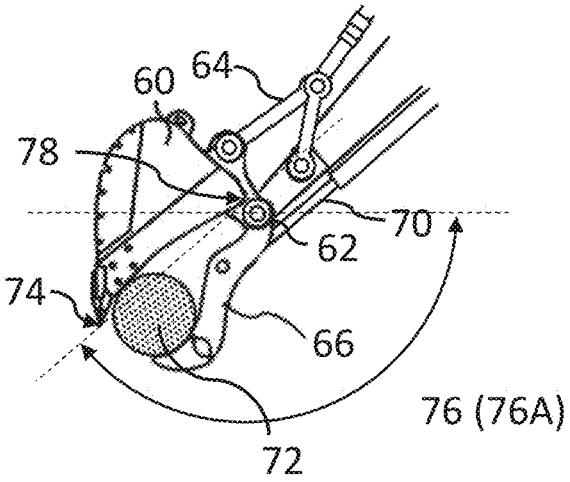
FIGS. 3A, 3B, and 3C are side views of a part of an arm of a work machine having a thumb bucket according to one or more embodiments of the disclosed subject matter.
Figure 3B:
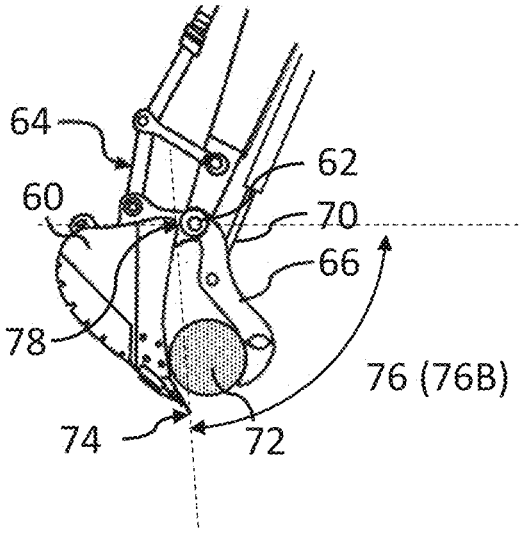
Figure 3C:
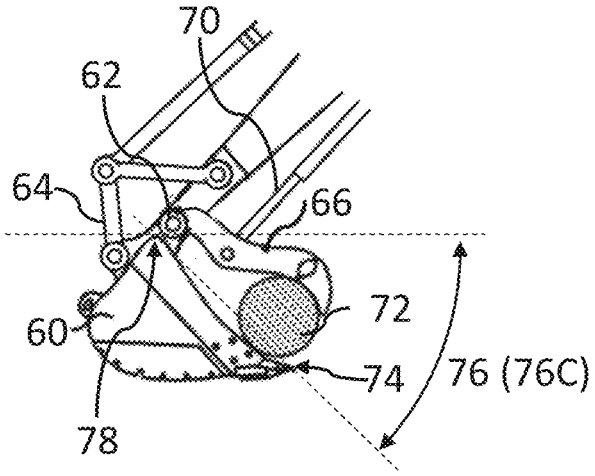

Turning now to FIGS. 3A, 3B, and 3C, FIGS. 3A, 3B, and 3C are side views of a part of an arm of a work machine 1 having a thumb bucket according to one or more embodiments of the disclosed subject matter. FIGS. 3A, 3B and 3C may illustrate that the work machine 1 can grab the material 72 with various bucket angles 76 (76A, 76B, and 76C). The bucket angles 76 (76A, 76B, and 76C) may be defined by an angle between a horizontal line and a line connecting a base point 78 of the bucket 60 and an end point 74 of a blade of the bucket 60. In one or more embodiments, the bucket angle 76 can be described as 0 degrees when the line connecting the base point 78 of the bucket 60 and the end point 74 of the blade of the bucket 60 overlaps the horizontal line, and the bucket angle 76 can increase counterclockwise more than 0 degrees, and can decrease clockwise less than 0 degrees. For instance, FIG. 3A may show that the bucket angle 76A is −120 degrees, FIG. 3B may show that the bucket angle 76B is −85 degrees, and FIG. 3C may show that the bucket angle 76C is −65 degrees, respectively.

Generally, it may be difficult to grab an object using the thumb 66 at the bucket angle 76 of −270 degrees or less. Also, it may be difficult to grab an object using the thumb 66 at the bucket angle 76 of −60 degrees or more. Therefore, if the work machine 1 detects that the bucket angle 76 is between −60 and −270 degrees and a weight of the material 72 between the bucket 60 and the thumb 66 exceeds a minimum payload, it may be assumed that the current task of the work machine 1 is grabbing. On the contrary, if the work machine 1 detects that the bucket angle 76 is between 90 and −60 degrees and a weight of the material 72 between the bucket 60 and the thumb 66 exceeds a minimum payload, it may be assumed that the current task of the work machine 1 is scooping.

Optionally or selectively, a velocity vector of the end point 74 may be also used as a parameter for determination of the current task of the work machine 1 in addition to the bucket angle 76. For example, the work machine 1 may determine whether the bucket 60 is moving toward scooping or grabbing based on the velocity vector of the end point 74.

In one or more embodiments, the work machine 1 may determine the bucket angle 76 and the direction of the velocity vector of the end point 74 when a calculated boom torque load exceeds a predetermined minimum payload. The process of determination of payload based on the bucket angle 76 and the direction of the velocity vector of the end point 74 will be described with reference to FIGS. 5-8.

Figure 4:
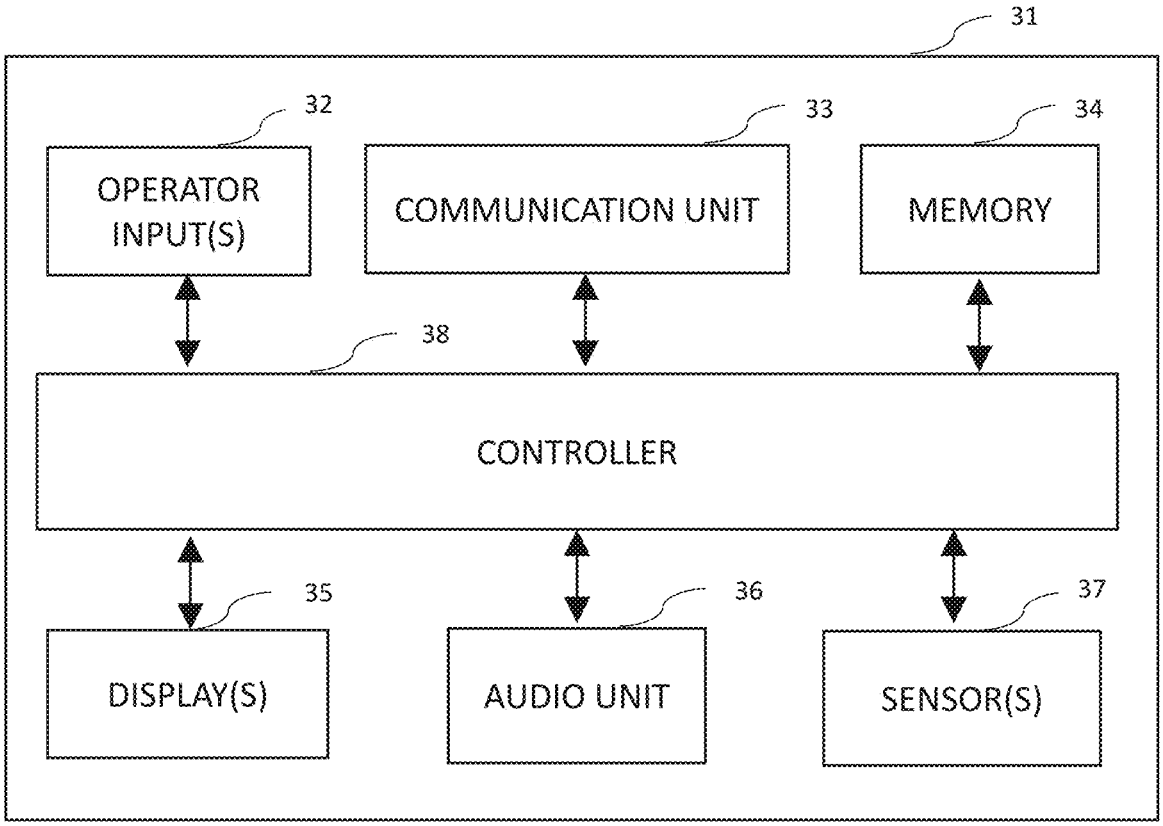
FIG. 4 shows a block diagram of a control system according to one or more embodiments of the disclosed subject matter.

Turning now to FIG. 4, FIG. 4 is a block diagram of a control system 31 of the work machine 1, according to one or more embodiments of the disclosed subject matter. As illustrated in FIG. 4, the control system 31 can include a controller 38, which may be implemented in or using control circuitry, one or more operator inputs 32, a communication unit 33, memory 34, one or more displays 35, an audio unit 36, and one or more sensors 37. The controller 38, as used herein, can include only one controller or multiple controllers.

The memory 34 may be operatively coupled to the controller 38 and may reside outside of the controller 38, such as shown in FIG. 4, and/or within the controller 38, i.e., as part of the controller 38. Generally, the memory 34 can receive and save therein data or information regarding operation of the work machine 1. As examples, the memory 34 can receive and save therein setting information of the predetermined minimum payload, a predetermined range of the bucket angle 76, and a current mode of the thumb bucket.

The communication unit 33 may be (or may be part of) the control system 31. In this regard, the communication unit 33 can include transmit circuitry to transmit information or data, such as the setting information of the predetermined minimum payload, the predetermined range of the bucket angle 76, and the current mode of the thumb bucket, to a back office system. Optionally, the communication unit 33 can have receive circuitry to receive information or data from the back office system, for instance. In this embodiment, the communication unit 33 can be configured using a communication device such as a local CAN, a wired or wireless LAN, a communication card for Bluetooth, a router for communication, and a modem for communication.

The audio unit 36 may be comprised of one or more audio speakers, for instance, provided in the cab 5, to output audible information, such as alerts, to the operator of the work machine 1. As an example, the audio unit 36 can output an audible information which mode of the thumb bucket is currently selected by an operator of the work machine 1.

The one or more sensors 37 can detect various information of the work machine 1. For instance, the one or more sensors 37 can include a position sensor associated with rotation or swing of the work machine 1, a triaxial acceleration sensor (including an acceleration sensor, a gravity detection sensor, and a fall detection sensor) or a triaxial gyro sensor (including an angular velocity sensor, and a geomagnetic sensor). Outputs from the one or more sensors 37 may be fed back to the controller 38. Optionally, information from at least one of the one or more sensors 37 may be displayed on the display 35. As an example, the one or more sensors 37 can detect the bucket angle 76 of the work machine 1.

The operator input(s) 32 can be (or can be part of) switches, a joystick lever, a foot pedal, a keyboard, and other input devices. Operator input to the display 35 can be implemented by a touch panel equipped with the display 35. In this regard, such at least one display 35 may be implemented on a display device operative to display a graphical user interface (GUI). Optionally, the one or more displays 35 may output an alert and a message to the operator of the work machine 1, for instance, information of the current mode of the thumb bucket of the work machine 1.

The controller 38 can output control signaling to various system components (e.g., hydraulic systems, electrical systems, etc.) to control movement of the working machine 1 responsive to the operator input(s) 32. The controller 38 can include a CPU, a ROM, and a RAM.

In an exemplary implementation, the control system 31 of the work machine 1, or portions thereof, can be implemented using circuitry or processing circuitry that can include general purpose processors, special purpose processors, integrated circuits, ASICs ("Application Specific Integrated Circuits"), CPU (a Central Processing Unit), a micro processing unit (MPU), conventional circuitry and/or combinations thereof which are configured or programmed to perform the disclosed functionality. Processors can be considered processing circuitry or circuitry as they include transistors and other circuitry therein. The processor may be a programmed processor which executes a program stored in a memory. In the disclosure, the circuitry, units, or means can be hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units can be a combination of hardware and software, the software being used to configure the hardware and/or processor.

Figure 5:
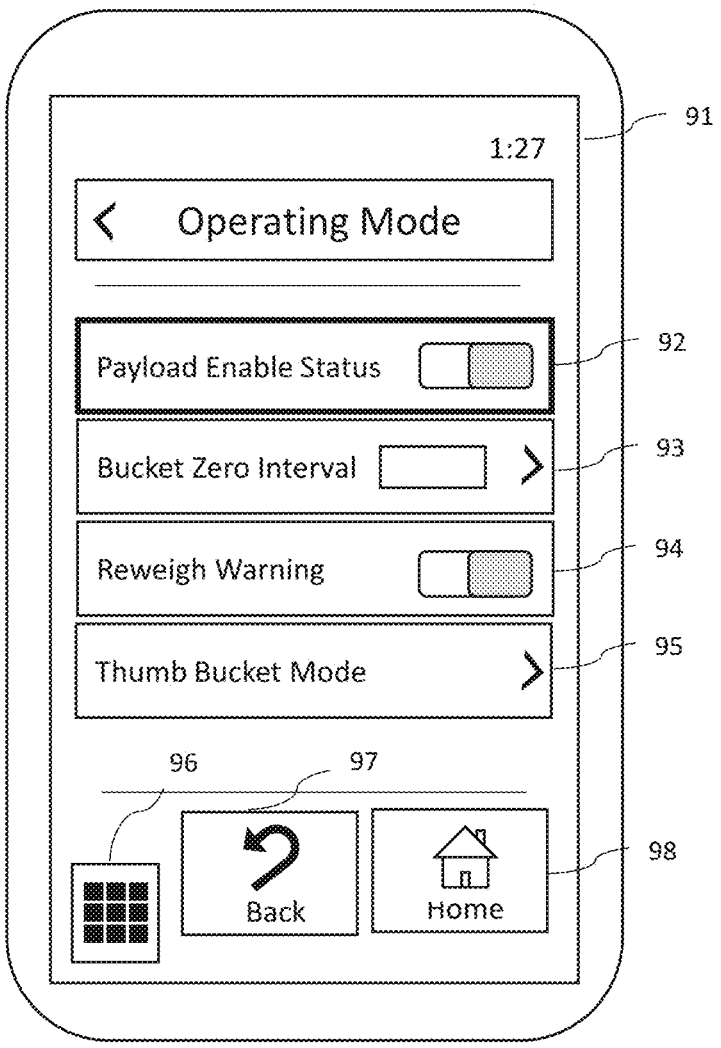
FIG. 5 shows an exemplary operator interface according to one or more embodiments of the disclosed subject matter.
Figure 6:
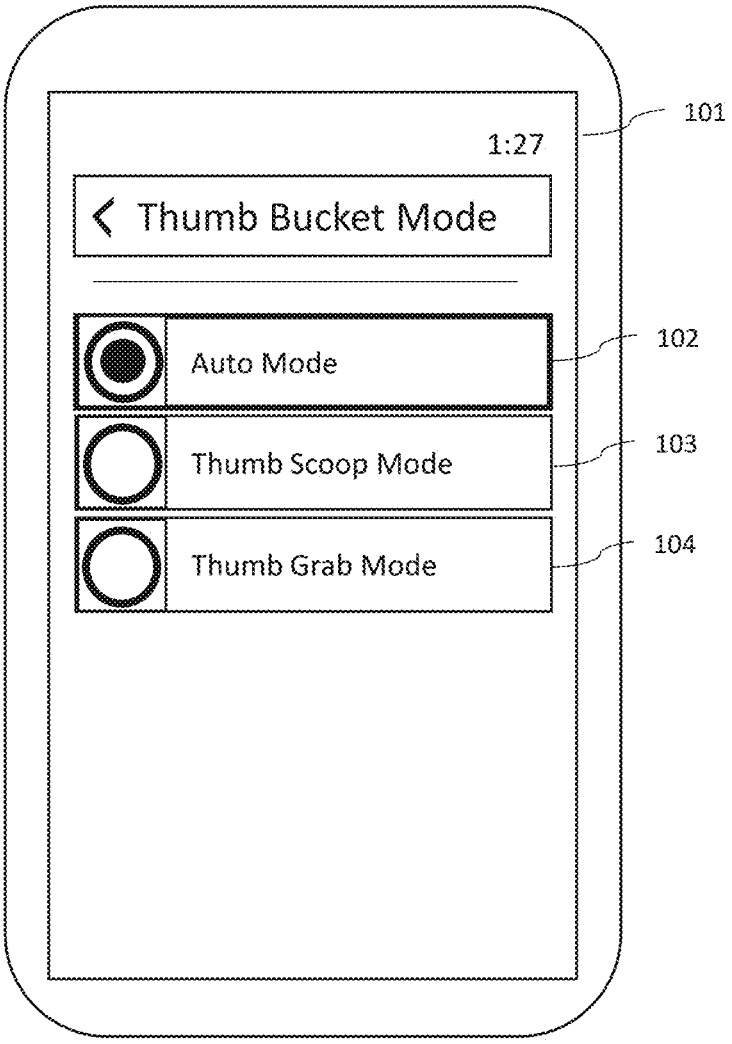
FIG. 6 shows an exemplary operator interface according to one or more embodiments of the disclosed subject matter.
Figure 7:
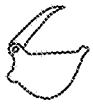
FIG. 7 shows a schematic illustration of transition of icon status according to one or more embodiments of the disclosed subject matter.
Figure 7:
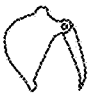
Figure 7:
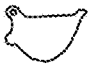
Figure 7:
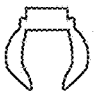
Figure 7:
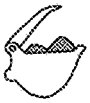
Figure 7:
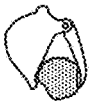
Figure 7:
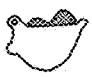
Figure 7:
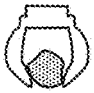
Figure 7:
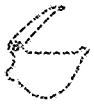
Figure 7:
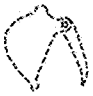
Figure 7:
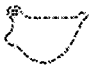
Figure 7:
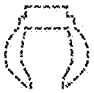
Figure 7:
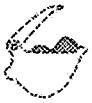
Figure 7:
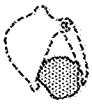
Figure 7:
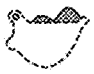
Figure 7:
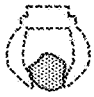

FIGS. 5-7 show exemplary operator interfaces, which may be provided on at least one display 35, and which may be implemented on a display device operative to display a graphical user interface (GUI), according to one or more embodiments of the disclosed subject matter.

FIG. 5 shows a schematic illustration of the display 35 when setting an operating mode of the work machine 1. The display 35 can display a screen 91 for setting an operating mode of the work machine 1. Here, in FIG. 5, a field 92 may be currently selected to set "Payload Enable Status" to be activated. When the "Payload Enable Status" is activated, the controller 38 of the work machine 1 may calculate the payload disposed in the work tool (e.g., the bucket 60) based on an instruction input from the operator of the work machine 1, or periodically.

Similarly, a field 93 can be for setting "Bucket Zero Interval" which may define an interval of bucket zero calibration for adjusting parameters of sensor(s) implemented in the work machine 1 (e.g., a weight sensor of the bucket 60) for accurate calculation of the payload. In one or more embodiments, the "Bucket Zero Interval" can be input as any values (e.g., 24 hour).

Similarly, a field 94 can be for setting "Reweigh Warning" whether to activate or not to output an alert that can be shown during using the function of payload to the operator of the work machine 1. When the "Reweigh Warning" is activated, the controller 38 of the work machine 1 may output the alert to the operator of the work machine 1 via the display 35 or the audio unit 36. More practically, when the "Reweigh Warning" is activated, for example, if the function of payload is used under circumstance that the boom 5 is in high position, an alert "Boom Too High" may be output to the operator of the work machine 1 via the display 35 or the audio unit 36.

A field 95 can be for setting "Thumb Bucket Mode" to select a mode for calculating payload from some options in a case that the work tool is the thumb bucket (i.e., the structure including the thumb 66 and the bucket 60). The operator of the work machine 1 may provide an input to the field 96 to change the mode for calculating payload, for instance, by selecting "Thumb Bucket Mode" on the screen 91. Setting the "Thumb Bucket Mode" will be described with FIG. 6.

Optionally, the screen 91 can include fields 96-98 for a menu button, a back button, and a home button, respectively. The field 96 for the menu button can be to show a list of menu items, the field 97 for the back button can be to return to previous screen, and the field 98 for the home button can be to return to a home screen.

Optionally, as shown in FIG. 5, the display 35 can be equipped with the touch panel to input information to the controller 38, such as the setting information corresponding to the fields 92-95, and the commands corresponding to the menu button, the back button, and the home button can be input via the screen 91 by the touch panel of the display 35.

It is noted that embodiments of the disclosed subject matter are not limited to the specific arrangement of the fields and the buttons on the screen as shown in FIG. 5. For instance, embodiments of the disclosed subject matter can arrange the fields and the buttons in different positions or include more fields and buttons on the screen for other functions of the work machine 1.

FIG. 6 is a schematic illustration of the display 35 when setting the mode for calculating payload of the work machine 1. The display 35 can display a screen 101 for selecting the mode for calculating payload of the work machine 1 from "Auto Mode," "Thumb Scoop Mode," and "Thumb Grab Mode."

A field 102 can be an option of "Auto Mode" as the mode for calculating payload of the work machine 1. In this embodiment, the option of "Auto Mode" may be selected as a default value. When the option of "Auto Mode" is selected by the operator, the COG of the payload may be automatically switched between the COG under a condition that the work machine1 is grabbing an object (i.e., 80A shown in FIG. 2A, hereinafter, a first COG) and the COG under a condition that the work machine1 is scooping an object (i.e., 80B shown in FIG. 2B, a second COG), in accordance with determination of payload based on the bucket angle 76 and the direction of the velocity vector of the end point 74. Here, the COG of the payload may be defined as the COG calculated from the total weight of the payload in the bucket 60 and the weight of the bucket 60.

A field 103 can be an option of "Thumb Scoop Mode" as the mode for calculating payload of the work machine 1. When the option of "Thumb Scoop Mode" is selected by the operator, the COG of the payload may be calculated under the condition that the work machine1 is scooping an object (i.e., 80B shown in FIG. 2B, the second COG). For instance, the option of "Thumb Scoop Mode" may be intentionally selected if the operator of the work machine 1 continues scooping task for a predetermined time.

A field 104 can be an option of "Thumb Grab Mode" as the mode for calculating payload of the work machine 1. When the option of "Thumb Grab Mode" is selected by the operator, the COG of the payload may be calculated under the condition that the work machine1 is grabbing an object (i.e., 80A shown in FIG. 2A, the first COG). For instance, the option of "Thumb Grab Mode" may be intentionally selected if the operator of the work machine 1 continues grabbing task for a predetermined time.

Optionally, as shown in FIG. 6, the display 35 can be equipped with the touch panel to input information to the controller 38, so the setting information corresponding to the fields 102-104 can be input via the screen 101 by the touch panel of the display 35.

It is noted that embodiments of the disclosed subject matter are not limited to the specific arrangement of the fields and the buttons on the screen as shown in FIG. 6. For instance, embodiments of the disclosed subject matter can arrange the fields and the buttons in different positions or include more fields and buttons on the screen for other functions of the work machine 1.

Turning now to FIG. 7, FIG. 7 shows a schematic illustration of transition of icon status displayed on the display 35. In one or more embodiments, FIG. 7 shows icon status 202 on a basis of weigh status 201. More specifically, each of columns 203 to 205 may correspond to the performing task in association with a specific attachment tool of the work machine 1, such as "Thumb Scoop", "Thumb Grab", "Bucket", and "Grapple", respectively. For example, the column 203 may show the icons based on the weigh status 201 when the work machine 1 is performing the scooping task with the thumb 66 and the bucket 60 as the attachment tool. Similarly, the column 204 may show the icons based on the weigh status 201 when the work machine 1 is performing the grabbing task with the thumb 66 and the bucket 60 as the attachment tool. Similarly, the column 205 may show the icons based on the weigh status 201 when the work machine 1 is performing the scooping task by the bucket 60 without the thumb 66 as the attachment tool. Similarly, the column 206 may show the icons based on the weigh status 201 when the work machine 1 is performing the grabbing task by a grapple as the attachment tool.

In one or more embodiments, "Estimated Weight Complete 211," "Estimated Weighing 212," "Scaled Weight Complete 213," and "Scaled Weighing 214" may be defined as the weigh status 201. Each of the weigh status 201 will be described with reference to FIGS. 8A-8B and 9.

Figure 8A:
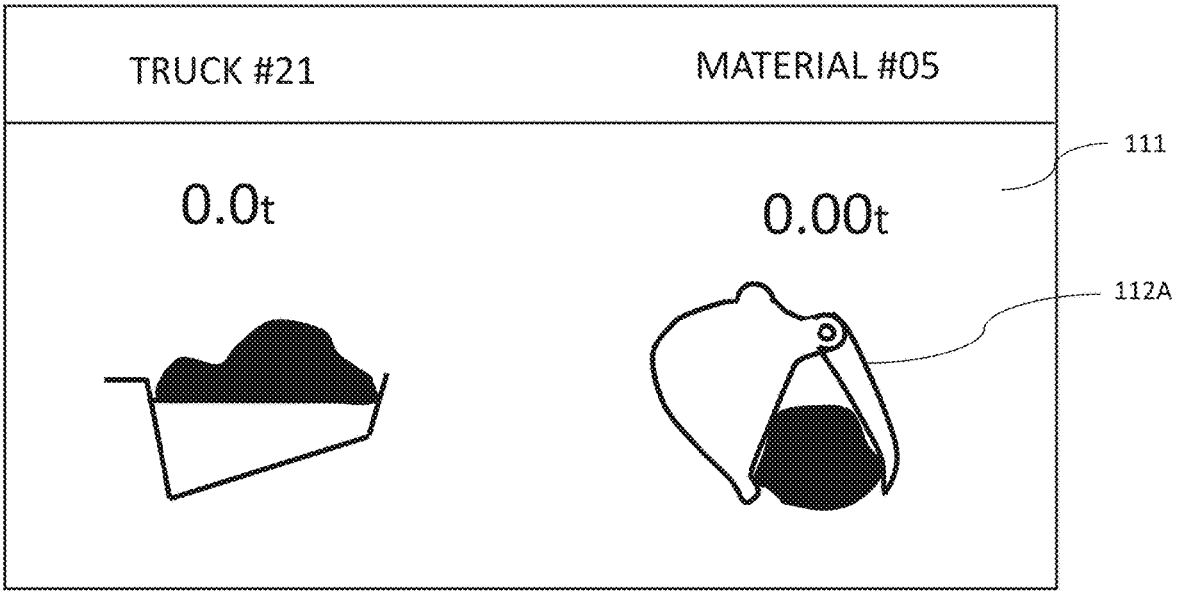
FIGS. 8A and 8B show exemplary operator interfaces according to one or more embodiments of the disclosed subject matter.
Figure 8B:
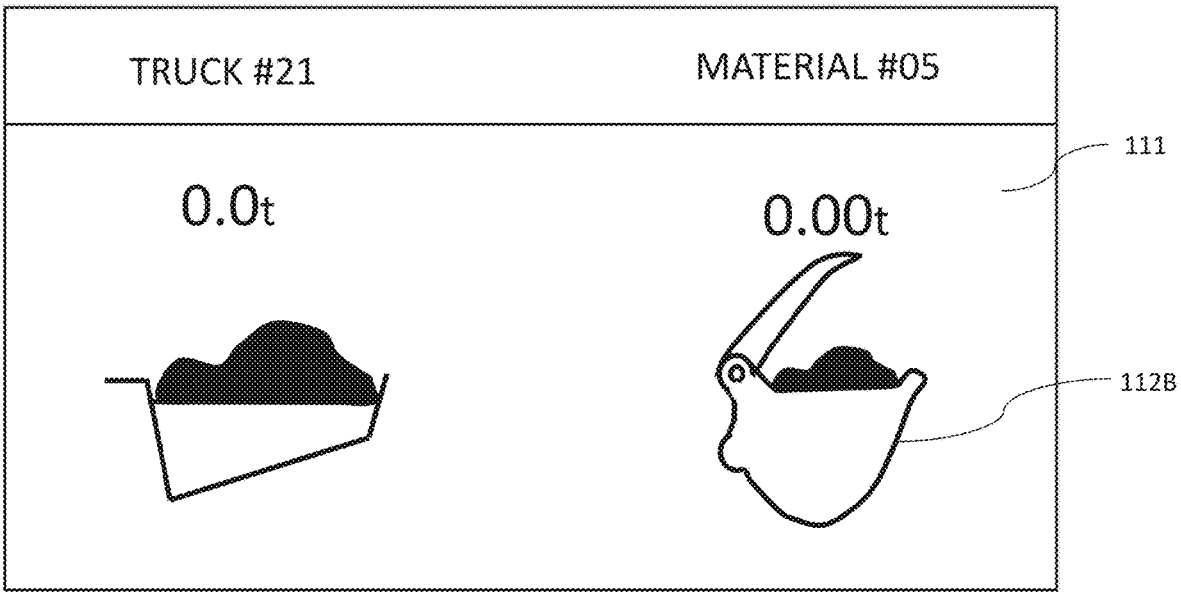

Turning now to FIGS. 8A and 8B, FIGS. 8A and 8B show a schematic illustration of a home screen of payload displayed on the display 35. In one or more embodiments, FIG. 8A may show that an icon 112A which indicates that the work machine 1 is performing the grabbing task is displayed on a home screen 111 of the display 35. More specifically, when the controller 38 determines that the work machine 1 is performing the grabbing task based on the bucket angle 76, the icon 112A may be displayed on the home screen 111 of the display 35 to output the current mode for calculating payload of the work machine 1 to the operator of the work machine 1. The icon 112A may correspond to the icon of the column 204 of the icon status 202 when the weigh status 201 is "Estimated Weighing 212" shown in FIG. 7.

Similarly, FIG. 8B may show that an icon 112B which indicates that the work machine 1 is performing the scooping task is displayed on a home screen 111 of the display 35. More specifically, when the controller 38 determines that the work machine 1 is performing the scooping task based on the bucket angle 76 and the direction of the velocity vector of the end point 74 as shown in FIGS. 3A to 3C, the icon 112B may be displayed on the home screen 111 of the display 35 to output the current mode for calculating payload of the work machine 1 to the operator of the work machine 1. The icon 112B may correspond to the icon of the column 203 of the icon status 202 when the weigh status 201 is "Estimated Weighing 212" shown in FIG. 7.

Optionally or alternatively, when the payload is discharged from the bucket 60, the icons 112A and 112B may be changed to alternative icons which show updated statuses of "empty" payload in the bucket, respectively. For instance, when the payload is discharged from the bucket 60, the icon 112A may be changed to an icon corresponding to the column 204 of the icon status 202 which the weigh status 201 is "Scaled Weight Complete 213" shown in FIG. 7. Similarly, when the payload is discharged from the bucket 60, the icon 112B may be changed to an icon corresponding to the column 203 of the icon status 202 which the weigh status 201 is "Scaled Weight Complete 213" shown in FIG. 7.

Optionally or alternatively, when the payload in the bucket 60 is scaled, the icons 112A and 112B may be changed to alternative icons which show updated statuses of "scaled" payload in the bucket, respectively. For instance, when the payload in the bucket 60 is scaled, the icon 112A may be changed to an icon corresponding to the column 204 of the icon status 202 which the weigh status 201 is "Scaled Weighing 214" shown in FIG. 7. Similarly, when the payload in the bucket 60 is scaled, the icon 112B may be changed to an icon corresponding to the column 203 of the icon status 202 which the weigh status 201 is "Scaled Weighing 214" as shown in FIG. 7.

Optionally or alternatively, other icons indicating other statuses of the work tool such as "Grapple," "Bucket (scoop without thumb)," etc. as shown in FIG. 7 can be displayed on the home screen 111 of the display 35.

It is noted that embodiments of the disclosed subject matter are not limited to the specific arrangement of the fields and the buttons on the home screen of payload as shown in FIGS. 8A and 8B. For instance, embodiments of the disclosed subject matter can arrange the fields and the buttons in different positions or include more fields and buttons on the home screen of payload for other functions of the work machine 1.

INDUSTRIAL APPLICABILITY

As noted above, the present disclosure relates to work machines, and more particularly to construction machines having a thumb bucket for grabbing or scooping an object, and systems, assemblies, and methods thereof.

Figure 9:
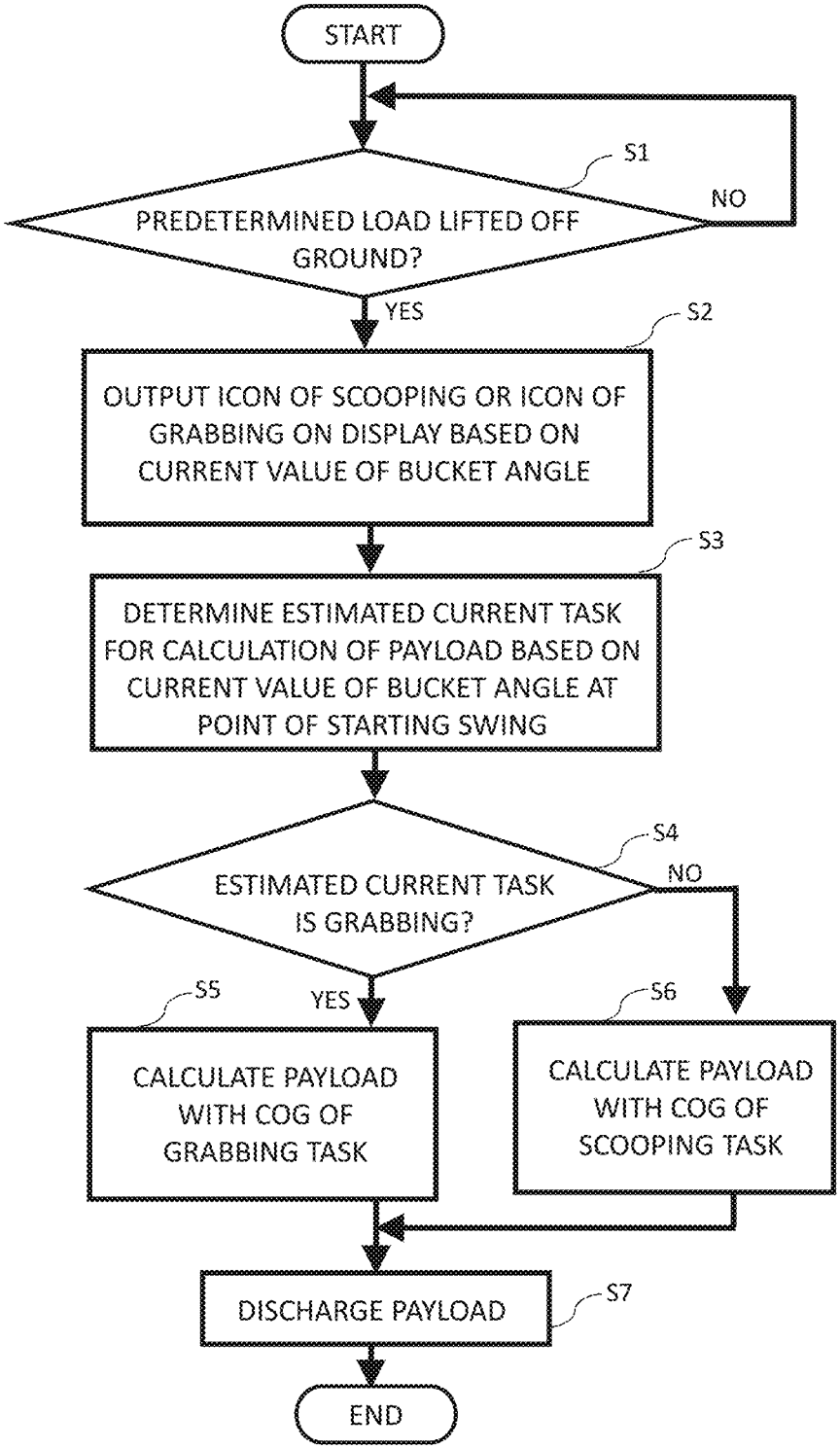
FIG. 9 is a flowchart of a method according to one or more embodiments of the disclosed subject matter.

FIG. 9 is a flowchart of a method of controlling calculation of payload in the "Auto mode," according to one or more embodiments of the disclosed subject matter. Some or all of the operations of the methods can be performed by or using the controller 38. Further, some or all of each of the methods can be performed via a non-transitory computer-readable storage medium (or media) having stored thereon instructions that, when executed by one or more processors (e.g., of the controller 38) causes the one or more processors to perform some or all of the method(s).

The process of controlling calculation of payload in the "Auto mode" may be initiated when the work machine 1 detects that a load in the work tool (i.e., the thumb bucket) is lifted off the ground. Prior to the process, the mode for calculating payload of the work machine 1 may be selected as "Auto mode" as shown in FIG. 6. The controller 38 may determine whether a predetermined minimum amount of load in the work tool (i.e., the thumb bucket) is lifted off the ground (S1). Practically the predetermined minimum amount of load may be factory-set for each model of the work machine 1 in advance to the process.

Next, in the case where the determination of step S1 is YES, the controller 38 may perform a process of outputting estimated information of a current task of the work machine 1 by displaying either one of the icons 112A and 112B on the home screen 111 of payload, based on a current value of the bucket angle 76 (S2). Practically, the current value of the bucket angle 76 can be detected by sensor(s) 37 attached to the arm 50 of the work machine 1. In particular, if the current value of the bucket angle 76 of the work machine 1 is within a range of −60 degree to −270 degree as shown in FIGS. 3A to 3C, the controller 38 may determine that the estimated current task of the work machine 1 is grabbing. On the other hand, if the current value of the bucket angle 76 of the work machine 1 is not within the range of −60 degree to −270 degree, the controller 38 may determine that the estimated current task of the work machine 1 is scooping.

Optionally or alternately, the controller 38 may also display a current value of payload in addition to the icons 112A or 112B on the home screen 111 of payload as shown in FIGS. 8A and 8B. In one or more embodiments, the current value of payload may be estimated based on the weight of material inside the bucket 60 by calculating a torque value of the boom 5.

On the other hand, in the case where the determination of step S1 is NO, i.e., the controller 38 does not detect predetermined amount of load in the work tool, the processing may return to S1 of the processing shown in FIG. 9.

Next, the controller 38 may perform a process of determination of an estimated current task of the work machine 1 for calculation of payload, based on a current value of the bucket angle 76 at a point of starting swing of the arm 50 of the work machine 1 (S3). Practically, the controller 38 may detect the point of starting swing of the arm 50 of the work machine 1 by the sensor(s) 37 attached to the arm 50 of the work machine 1. In particular, if the current value of the bucket angle 76 at the point of starting swing of the arm 50 of the work machine 1 is within a range of −60 degree to −270 degree as shown in FIGS. 3A to 3C, the controller 38 may determine that the estimated current task of the work machine 1 is grabbing. On the other hand, if the current value of the bucket angle 76 at the point of starting swing of the arm 50 of the work machine 1 is not within the range of −60 degree to −270 degree, the controller 38 may determine that the estimated current task of the work machine 1 is scooping.

In one or more embodiments, from the point of starting swing of the arm 50 of the work machine 1, the controller 38 may not change the estimated current task of the work machine 1 and keep outputting the either one of the icons 112A and 112B on the home screen 111 of payload continuously.

Next, if the controller 38 determines that estimated current task of the work machine 1 is grabbing according to the above described determination (Yes at step S4), the controller 38 may calculate payload by using the COG of the payload as the first COG (e.g., 80A shown in FIG. 2A) (S5). Optionally, at step S5, the controller 38 may output the calculated payload by using the COG of the payload as the first COG on the display 35 as shown in FIG. 8A.

Subsequent to step S5, the controller 38 may control to discharge payload (S7) and terminate the process.

Alternately, if the controller 38 determines that estimated current task of the work machine 1 is scooping according to the above described determination (NO at step S4), the controller 38 may calculate payload by using the COG of the payload as the second COG (e.g., 80B shown in FIG. 2B) (S6). Optionally, at step S6, the controller 38 may output the calculated payload by using the COG of the payload as the second COG on the display 35 as shown in FIG. 8B.

Subsequent to step S6, the controller 38 may control to discharge payload (S7) and terminate the process.

It is noted that embodiments of the disclosed subject matter are not limited to the specific arrangement of the processing steps as shown in FIG. 9. For instance, embodiments of the disclosed subject matter can add more processing steps to control calculation and discharge of the payload of the work machine 1.

As a result of the embodiments, a work machine can determine whether the work machine is performing grabbing or scooping with a thumb bucket, and automatically switch a center of gravity position of payload based on the performing task so that the work machine can determine payload accurately regardless of the order of the tasks.

Thus, according to embodiments of the disclosed subject matter, a work machine can comprise a bucket attached to an end of a stick of the work machine as a work tool, a thumb pivotally coupled to the end of the stick, and processing circuitry. The processing circuitry can be configured to determine a current task of the work machine among scooping an object by the bucket or grabbing an object by the bucket and the thumb, based on an angle of the bucket, and calculate payload with a parameter of a center of gravity position of the payload based on the determined current task.

The work machine can automatically switch a center of gravity position of payload based on the performing task so that the work machine can determine payload accurately regardless of the order of the tasks.

In another aspect, a method for a work machine is disclosed or implemented. The method can comprise determining a current task of the work machine among scooping an object by a bucket or grabbing an object by the bucket and a thumb, based on an angle of the bucket, the bucket being attached to an end of a stick of the work machine as a work tool and the thumb being pivotally coupled to the end of the stick, calculating payload with a parameter of a center of gravity position of the payload based on the determined current task, and outputting, on a display of the work machine, the calculated payload.

And in another aspect a non-transitory computer-readable storage medium is disclosed or provided. The non-transitory computer-readable storage medium can comprise computer executable instructions, wherein the instructions, when executed by an information processing system of a work machine, cause the information processing system to perform a method, the method comprising, setting a mode for calculation of payload as an automatic mode, determine a current task of the work machine among scooping an object by a bucket or grabbing an object by the bucket and a thumb, based on an angle of the bucket, the bucket being attached to an end of a stick of the work machine as a work tool and the thumb being pivotally coupled to the end of the stick, and calculating payload with a parameter of a center of gravity position of the payload based on the determined current task.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A work machine comprising:

a bucket attached to an end of a stick of the work machine as a work tool;

a thumb pivotally coupled to the end of the stick; and processing circuitry configured to determine a current task of the work machine among scooping an object by the bucket or grabbing the object by the bucket and the thumb, based on an angle of the bucket, automatically switch a center of gravity position of payload based on the determined current task, and calculate the payload with a parameter of the center of gravity position of the payload based on the determined current task.

2. The work machine according to claim 1, wherein the angle of the bucket is an angle of a line between an end point of the bucket and a base point of the bucket from a horizontal line in a side view of the work machine.

3. The work machine according to claim 2, wherein the processing circuitry is further configured to determine the current task based on a velocity vector of the end point of the bucket.

4. The work machine according to claim 2, wherein the processing circuitry is configured to determine that the current task of the work machine is grabbing the object under a condition that the angle of the bucket is within a predetermined range in the side view of the work machine.

5. The work machine according to claim 4, wherein the predetermined range of the angle of the bucket is identified by a first value and a second value, the first value being defined clockwise from the horizontal line and the second value being defined counterclockwise from the horizontal line in the side view of the work machine.

6. The work machine according to claim 1, wherein the parameter of the center of gravity position of the payload in a case that the current task of the work machine is grabbing the object is different from the parameter of the center of gravity position of the payload in a case that the current task of the work machine is scooping the object.

7. The work machine according to claim 1, wherein the processing circuitry is configured to output information of the current task of the work machine on a display.

8. The work machine according to claim 7, wherein the processing circuitry is configured to output the information of the current task of the work machine by an icon of the current task on the display.

9. The work machine according to claim 7, wherein the processing circuitry is configured to output selectable information to select a mode for calculating the payload on the display.

10. A method for controlling a work machine comprising:

determining, using circuitry of the work machine, a current task of the work machine among scooping an object by a bucket or grabbing the object by the bucket and a thumb, based on an angle of the bucket, the bucket being attached to an end of a stick of the work machine as a work tool and the thumb being pivotally coupled to the end of the stick;

automatically switching, using the circuitry of the work machine, a center of gravity position of payload based on the determined current task;

calculating, using the circuitry of the work machine, the payload with a parameter of the center of gravity position of the payload based on the determined current task; and outputting, using the circuitry of the work machine, on a display of the work machine, the calculated payload.

11. The method according to claim 10, wherein the angle of the bucket is an angle of a line between an end point of the bucket and a base point of the bucket from a horizontal line in a side view of the work machine.

12. The method according to claim 11, further comprising:

determining, using the circuitry of the work machine, the current task based on a velocity vector of the end point of the bucket.

13. The method according to claim 11, further comprising:

determining, using the circuitry of the work machine, that the current task of the work machine is grabbing the object under a condition that the angle of the bucket is within a predetermined range in the side view of the work machine.

14. The method according to claim 13, wherein the predetermined range of the angle of the bucket is identified by a first value and a second value, the first value being defined clockwise from the horizontal line and the second value being defined counterclockwise from the horizontal line in the side view of the work machine.

15. The method according to claim 10, wherein the parameter of the center of gravity position of the payload in a case that the current task of the work machine is grabbing the object is different from the parameter of the center of gravity position of the payload in a case that the current task of the work machine is scooping the object.

16. The method according to claim 10, further comprising:

outputting, using the circuitry of the work machine, information of the current task of the work machine as an icon on the display.

17. The method according to claim 10, further comprising:

outputting, using the circuitry of the work machine, selectable information to select a mode for calculating the payload on the display.

18. A non-transitory computer-readable storage medium including computer executable instructions, wherein the instructions, when executed by an information processing system of a work machine, cause the information processing system to perform a method, the method comprising:

setting a mode for calculation of payload as an automatic mode;

determine a current task of the work machine among scooping an object by a bucket or grabbing the object by the bucket and a thumb, based on an angle of the bucket, the bucket being attached to an end of a stick of the work machine as a work tool and the thumb being pivotally coupled to the end of the stick; and calculating payload with a parameter of a center of gravity position of the payload based on the determined current task, wherein, said determining that the current task of the work machine is grabbing the object under a condition that the angle of the bucket is within a predetermined range in a side view of the work machine.

19. The non-transitory computer-readable storage medium according to claim 18, wherein the parameter of the center of gravity position of the payload in a case that the current task of the work machine is grabbing the object is different from the parameter of the center of gravity position of the payload in a case that the current task of the work machine is scooping the object.

* * * * *